United States Patent [19]

Bonse et al.

[11] Patent Number: 4,651,697

[45] Date of Patent: Mar. 24, 1987

[54] FUEL CONTROLLED INJECTION SYSTEM

[75] Inventors: Bernhard Bonse, Stuttgart; Peter-Jürgen Schmidt, Schwieberdingen, both of Fed. Rep. of Germany

[73] Assignee: Robert Bosch GmbH, Stuttgart, Fed. Rep. of Germany

[21] Appl. No.: 678,011

[22] Filed: Nov. 30, 1984

[30] Foreign Application Priority Data

Feb. 1, 1984 [DE] Fed. Rep. of Germany ..... 3403392

[51] Int. Cl.[4] ..... F02D 41/40

[52] U.S. Cl. ..... 123/436; 123/478

[58] Field of Search ..... 123/419, 436, 478, 352, 123/361, 399, 400, 401, 480

[56] References Cited

U.S. PATENT DOCUMENTS

| | | | |
|---|---|---|---|
| 4,138,979 | 2/1979 | Taplin | 123/436 |
| 4,329,960 | 5/1982 | Woodhouse et al. | 123/436 |
| 4,450,817 | 5/1984 | Ibuki et al. | 123/436 X |
| 4,478,186 | 10/1984 | Bauer et al. | 123/436 |

FOREIGN PATENT DOCUMENTS

| | | | |
|---|---|---|---|
| 0044656 | 1/1982 | European Pat. Off. | 123/419 |
| 2431865 | 1/1976 | Fed. Rep. of Germany . | |
| 2034930 | 5/1980 | United Kingdom | 123/436 |

*Primary Examiner*—Willis R. Wolfe, Jr.
*Attorney, Agent, or Firm*—Michael J. Striker

[57] ABSTRACT

A method of controlling fuel mixture supply to an internal combustion engine having fuel injection system in which the quantity of fuel is metered in dependency on gas pedal position and the quantity of air is subsequently metered in dependency on the position of the throttling plate. The method employs a preliminary control with superposed extreme value regulation. For this purpose, the injection time interval or the throttle plate position are adjusted in dependency on the gas pedal position and on the rotary speed of the engine. During the operation of the engine, test cycles are continuously established and according to the reaction of the engine to the tests, the adjustment of the injection time interval and of the throttle plate position are made. The method is suitable particularly for internal combustion engine used in motor vehicles.

28 Claims, 10 Drawing Figures

FUEL CONTROLLED INJECTION SYSTEM

BACKGROUND OF THE INVENTION

The present invention relates to a method of controlling and/or regulating fuel supply, preferably by means of fuel injection, to an internal combustion engine, wherein an injection time interval ($t_i$) and hence the quantity ($m_B$) of supply is determined in dependency on at least two engine parameters, such as gas pedal position ($\alpha_{SP}$) and rotary speed (n) and thereafter a quantity of air ($m_L$) is induced through throttling means including an adjustable throttling plate.

Particularly in motor vehicles, internal combustion engines are used operating either with a carburator or with a fuel injection system. These conventional fuel supply systems are air controlled systems. The sucked in quantity of air induced to the engine is predetermined by the position of throttling plate and by the rotary speed of the engine. The quantity of fuel supplied to the engine is subsequently adjusted according to the induced quantity of air. For metering the requisite quantity of air and for the additional metering of the quantity of fuel which depends on the metered amount of air, always require a certain period of time. In such air controlled fuel systems therefore the addition of a dose of fuel trails the induction of the metered quantity of air. This time delay, however, affects in a disadvantageous manner the transition behavior of the engine during a load change.

To avoid this shortcoming, another method has been developed wherein the quantity of fuel is predetermined by the gas pedal and corresponding quantity of air is supplied thereafter. The latter method is designated as a fuel controlled system. In spite of its advantages in comparison with air controlled systems, the fuel controlled system did not prevail in practice, inasmuch an accurate metering of the requisite quantity of air could be realized with considerable technological expenditures only.

The two beforementioned fuel supply systems and their disadvantages which are avoided by this invention, will be now briefly discussed with reference to FIGS. 1 to 4 of the drawing.

The behavior of an air controlled system in a dynamic mode of operation is illustrated in the plot diagram of FIG. 1. Dashed lines represent a constant quantity of fuel $m_B$, and full lines represent a constant quantity of air $m_L$. For instance, if effective pressure in a cylinder of the internal combustion engine is to be raised from a point a to a point b, then by means of the gas pedal the throttle plate must be opened to a certain angular position. As a consequence, the induced quantity of air $m_L$ is increased. Due to the inertia of the system, however, both the quantity of fuel $m_B$ and the rotary speed n of the engine remain momentarily constant. As a result, the effective pressure $P_e$ in the cylinder starts decreasing from the point a along the dashed line representing a constant quantity of fuel and only afterwards it rises along a curve to the desired value at the point b.

In the range of a rich mixture at an air ratio of $\lambda=0.9$, during the increase of the effective pressure $P_e$ from point d to point e, the behavior of the engine is better than in the preceding case. It will be seen that the effective pressure $P_e$ continuously increases, as it is desirable.

Nevertheless, in both cases there is the disadvantage that the fuel mixture for a transient period of time becomes lean. During the transition times from a to b or from d to e lean peaks occur in the exhaust gas which cause an increase of noxious components in the exhaust. Therefore an exactly opposite behavior is desired and within the both cases the wetting of the suction pipe with fuel must have increased.

If the effective pressure $P_e$ is to decrease, for example from point a to point c or from d to f than in the case of an air controlled system it is disadvantageous that the mixture is unnecessarily enriched, thus causing in the exhaust gas a peak of concentration of polluting agents.

Hence, the air controlled systems exhibit disadvantages in adjusting the mixture ratio particularly in lean mixtures.

Moreover, in any event detrimental peaks in exhaust gas will occur during the transition to another load condition.

The behavior of a fuel controlled system in a dynamic operation is graphically illustrated in the plot diagram in FIG. 2. Also in this diagram the effective pressure $P_e$ in a cylinder is plotted in dependency of air ratio $\lambda$ for constant quantities of fuel mB and constant quantities of air $m_L$.

It will be seen that fuel controlled system behaves on the leaner side of the fuel mixture as it is desirable. In increasing the effective pressure $P_e$ during acceleration, for example from point a to point b, the mixture becomes richer. In lowering the effective pressure $P_e$ during deceleration, for example from point a to point c, the mixture becomes leaner. This behavior has a favorable effect also on the correct wetting of the wall of the suction pipe. Consequently, also the behavior of exhaust gas is improved and concentrations of polluting agents are reduced.

At the rich side of the mixture, approximately at an air ratio of $\lambda=0.9$, the short drop of effective pressure $P_e$ during acceleration is with a certain disadvantage.

A fuel controlled fuel supply system therefore is particularly well suited for adjusting the components at the leaner side of the mixture. The detrimental exhaust gas peaks in load changes are substantially lower than in air controlled systems. As mentioned above, however, the realization of fuel controlled systems is substantially more expensive in comparison with air controlled systems.

The behavior of power output of the engine having air controlled system, be it a carburator type, or a fuel injection type system, is illustrated in the plot diagram in FIG. 3. The engine output N is plotted against rotary speed n and in dependency on angular position $\alpha_{DK}$ of throttle plate. It can be seen that in air controlled systems a very non-uniform driving behavior results at changing power output. For instance one drives uphill at a partial load, that means not with full gas, and consequently if the rotary speed n of the engine drops, then at a constant opening $\alpha_{DK}$ of the throttle plate the power output N decreases.

In fuel controlled systems there are essentially two possibilities how to determine the quantity of fuel by the position of the gas pedal, namely whether by dosing the quantity of fuel per stroke of the engine piston or per time unit. Since this invention is concerned with the first-mentioned possibility only, the power output characteristics of the latter will be considered below.

In fuel controlled systems in which fuel quantity is determined per time unit, one can adjust a quantity distributing piston via an eccenter by means of the gas pedal. From FIG. 4 it is evident that in such a system the power output N from a certain point decreases with increasing rotary speed n. The motor vehicle then behaves approximately so as if an automatic speed regulator be installed in the engine.

The combination of the two systems for metering fuel in internal combustion engines are also possible. One prior art system of this kind is known from the German publication No. 2,014,633 (assigned to the same assignee). In this known system the quantity of air and the quantity of fuel are controlled simultaneously in dependency on the position of the gas pedal and on the rotary speed of the engine.

From German publication No. 2,431,865 (assigned to the same assignee) a fuel controlled injection system is known in which gas pedal moves via a drag lever, an eccentric ball bearing on the quantity distributing piston and in doing so the injection of a predetermined quantity of fuel is controlled. Simultaneously, the injected fuel quantity is sensed by a potentiometer and applied as a desired value to a regulating amplifier. The regulating amplifier controls via a servo-motor the throttling plate in such a way that an air flow meter feeds back or returns a desired preset value. In this way a correct quantity of air is assigned to the predetermined quantity of fuel. However, since the maximum quantity of air depends also on the rotary speed of the engine, this known arrangement cannot preset any arbitrary desired value by means of the gas pedal. Therefore, there is a rotary speed dependent limit for the presetting of the amount of fuel. This is achieved by means of the drag lever whose limit stop is controlled by a rotary speed dependent setting motor. The construction of this known system is very expensive, particularly due to the large number of necessary sensors and adjustors. In addition, this system necessitates a relatively expensive air flow sensor.

In another known variation of the latter system which is somewhat simpler in construction, the injection time interval is preset by the position of the gas pedal. The throttling plate is adjusted by means of the setting motor in such a way that the quantity of air corresponding to the product of rotary speed and of the injection time interval is sensed at the air mass flow meter. This product must be generated in a control device and is used as a desired value for the regulating circuit. Even this simplified system is still relatively expensive even without regard to the cost of the air flow meter.

SUMMARY OF THE INVENTION

It is therefore a general object of the present invention to overcome the aforementioned disadvantages.

In particular, it is an object of this invention to provide a fuel supply regulating or controlling method of the aforedescribed kind which achieves a fine metering regulation of the fuel supply for the engine without the necessity of expensive technology.

Another object of this invention is to provide such regulation or control which can be made dependent on a plurality of operational parameters of the engine, also without additional technological expenditures. Since there is no rigid coupling between the movement of the gas pedal on one side, and the metered quantities of fuel and air on the other side, the effect of the engine parameters can be adjusted individually or in combination independently from each other.

Still another object of this invention is to provide a method which can dispense with an air mass flow meter.

In keeping with these objects and others which will become apparent hereafter, one feature of this invention resides in a method which includes the steps of establishing a test cycle (TZ) on the basis of predetermined test time intervals (ZI); then increasing, substantially at the beginning of a test cycle (TZ) during a predetermined test signal time (PS), an injection time interval ($t_i$) by a predetermined increment ($\Delta t_i$); then, in the course of the test cycle (TZ) measuring the actual rotary speed (n) substantially at the beginning (NFA) at the center (NFM) and at the end (NFE) of the test cycle (TZ); and after expiration of the test signal time (TS) after the end (NFE) of the test cycle, adjusting the injection time interval ($t_i$) in dependency on a measured change of rotary speed (n) at the center (NFM) of the test cycle.

Further advantages of the method of this invention reside in the fact that the engine can be arbitrarily controlled for maximum power output or for minimum fuel consumption.

Of advantage is also the division of the test cycle in a plurality of individual steps, so that a check up of a plurality of testing assumptions is made possible. In the event of a non-permissible change of a parameter the test cycle can be interrupted any time.

In the preferred embodiment of this invention, the method is carried out by a controlling or regulating device including one or more microcomputers. In this manner the expenditures for mechanical components are greatly reduced. The program of the microcomputers can be modified so that different regulating processes can be readily and in a simple manner changed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

FIGS. *7a* through *7d* illustrate a flow-chart of a computer program for carrying out the method of this invention.

DESCRIPTION OF THE PREFERRED EMBODIMENT

The diagrams of FIGS. 1 through 4 comparing the behavior of air controlled and fuel controlled fuel mixture supply systems have been discussed in preceding paragraphs to show clearly the advantages of fuel controlled fuel mixture supply systems over the air controlled systems.

Figure 1:
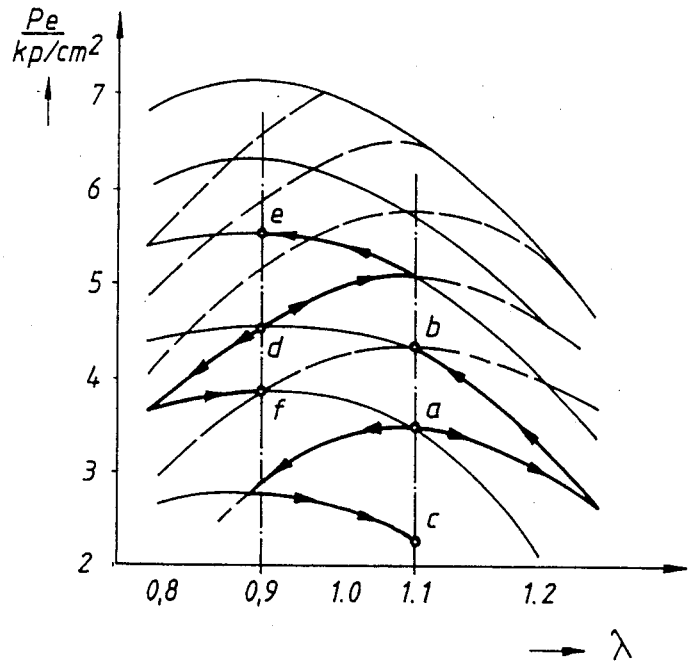
FIG. 1 is a plot diagram of effective pressure in a cylinder versus λ for constant quantities of supplied fuel and intake air in an air controlled fuel mixture supply system.
Figure 2:
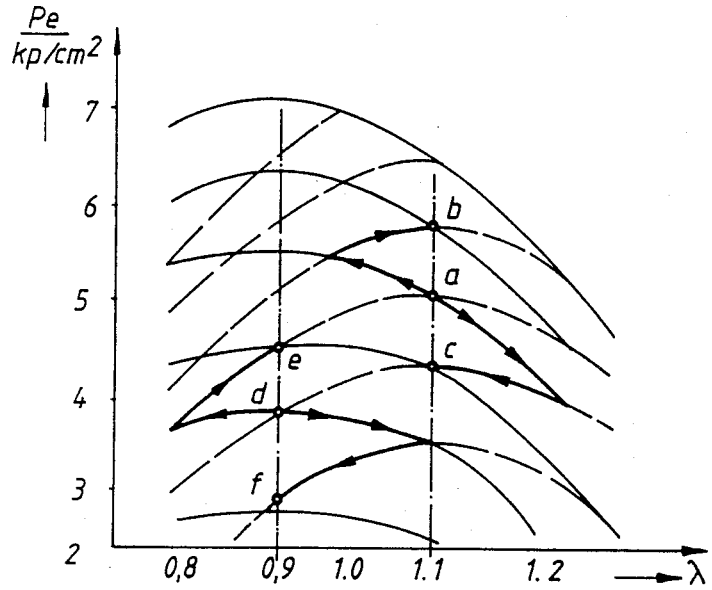
FIG. 2 is a plot diagram similar to FIG. 1 for a fuel controlled fuel mixture supply system.
Figure 3:
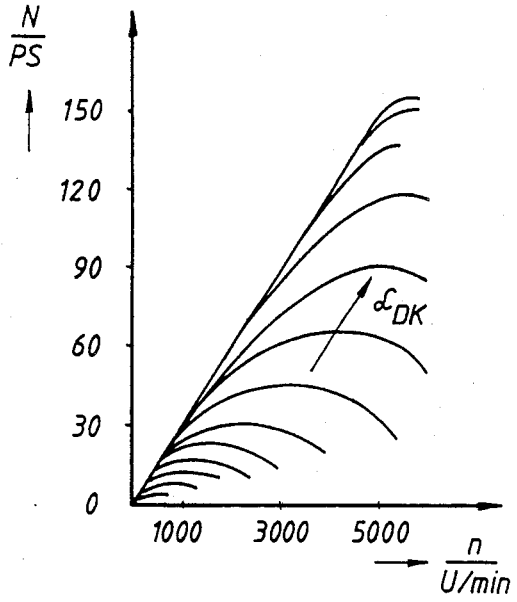
FIG. 3 is a plot diagram of power output versus rotary speed for increasing angular position of gas pedal in an air controlled fuel mixture supply system.
Figure 4:
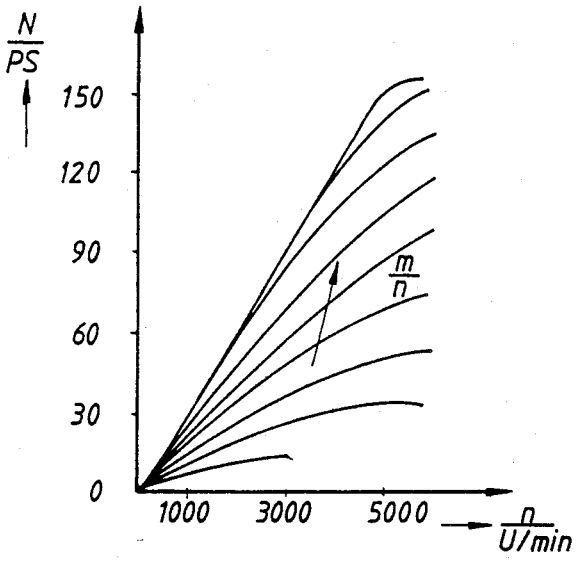
FIG. 4 is a plot diagram similar to FIG. 3 for increasing quantity of fuel in a fuel controlled fuel mixture supply system.
Figure 5:
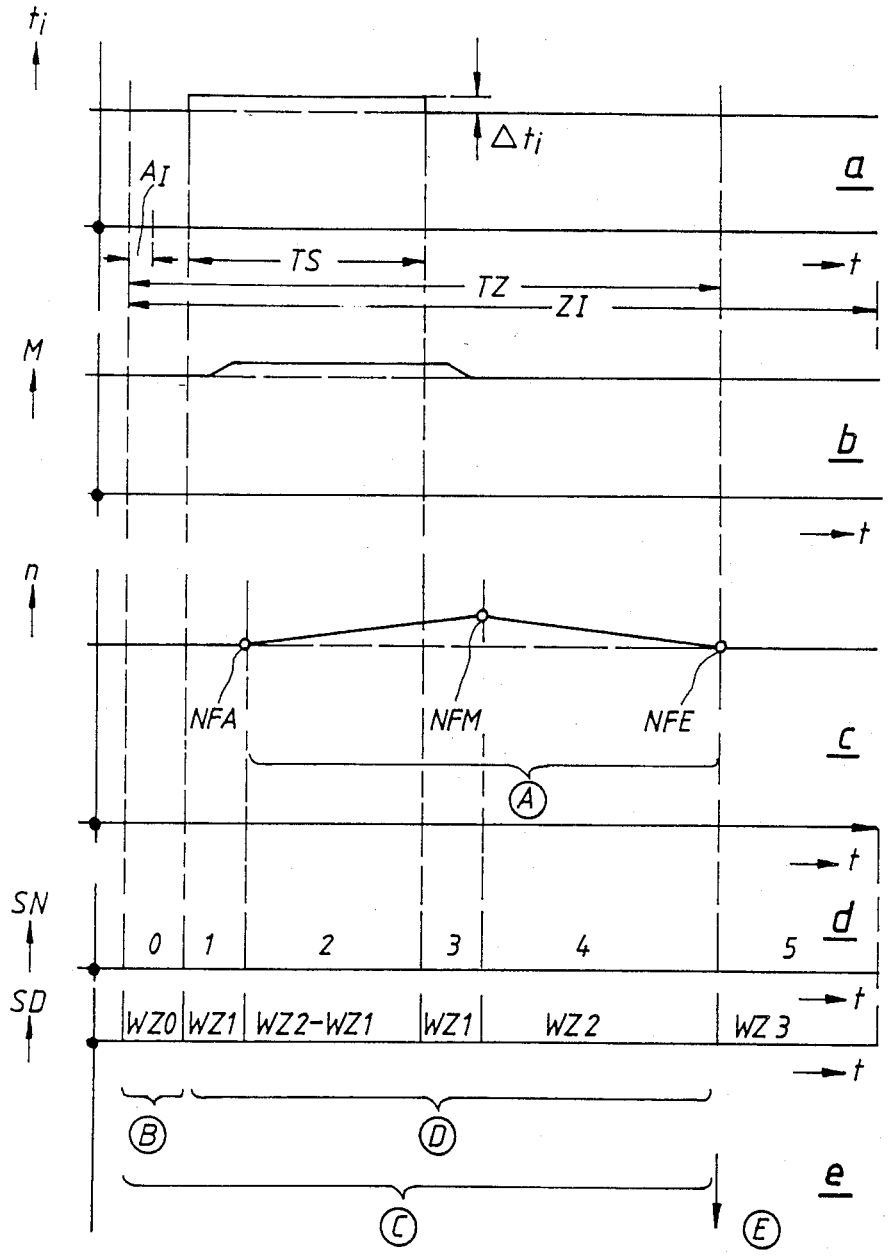
FIG. 5 is a time plot of the steps of testing and controlling process of this invention.

The graph of FIG. 5 illustrates the progress of a testing and controlling program according to this invention. FIG. 5A shows injection time interval $t_i$ versus time t. Within a predetermined test signal time TS the injection time interval $t_i$ is increased by a small increment $\Delta t_i$. FIG. 5A also indicates an approximate duration of a sensing or reading time interval AI, the duration of a testing cycle, TZ and the duration of the entire test time ZI, that is the interval from the beginning of a test cycle TZ, to the beginning of the following test cycle. The time intervals plotted in FIG. 5A correspond also to those indicated in the following plots of FIGS. 5B through 5E.

FIG. 5B illustrates the course of the torque M of the engine versus time d. It will be seen that the rise and drop of the torque M lags somewhat behind the rise and fall of the injection time interval $t_i$.

FIG. 5C shows the course of rotary speed n of the engine versus time t. As it will be explained below, output voltage of a rotary speed sensor is first filtered and the curve in FIG. 5C represents the time behavior of the filtered output voltage. At a time point NFA which is behind time point of increase of the engine torque, the rotary speed n starts increasing. At a subsequent time point NFM immediately after the damping of the increase of machine torque M, the rotary speed n has reached its maximum value. Thereafter, the value of the rotary speed decreases up to a time point NFE where it becomes constant. The entire time interval from NFA to NFE of the change of rotary speed is indicated by A.

FIG. 5D indicates the number of steps SN of the entire test time ZI. The durations SD of respective steps of FIG. 5D are illustrated in the time plot of FIG. 5E. The duration of step 0 is indicated by B, the duration of the following steps 1 through 4 with D, the duration of steps 0 through 4 is indicated by C, and at the end of step 4, a process E is initiated. The significance of the testing steps SN and of their duration SD will be explained below with reference to FIG. 6.

Figure 6:
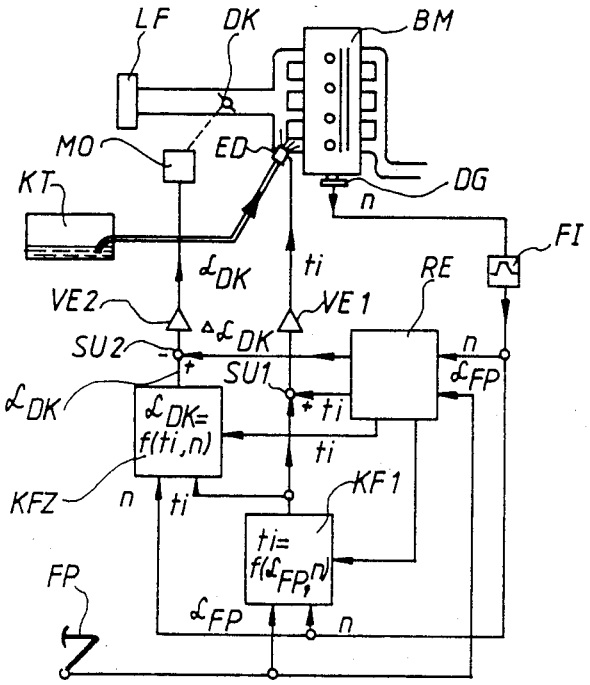
FIG. 6 is a schematic block circuit diagram of a device for carrying out the method of this invention.
Figure 7A:
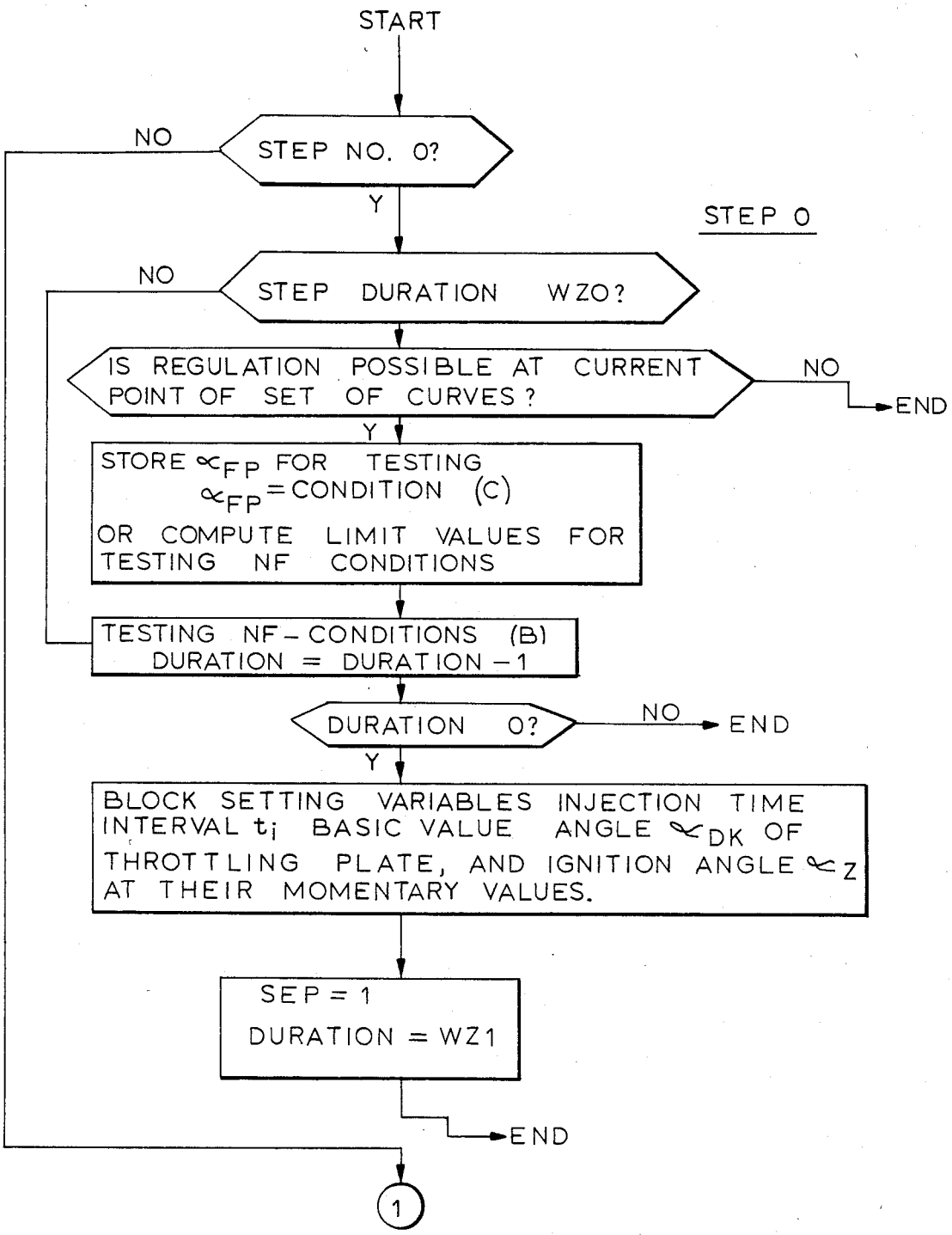
Figure 7B:
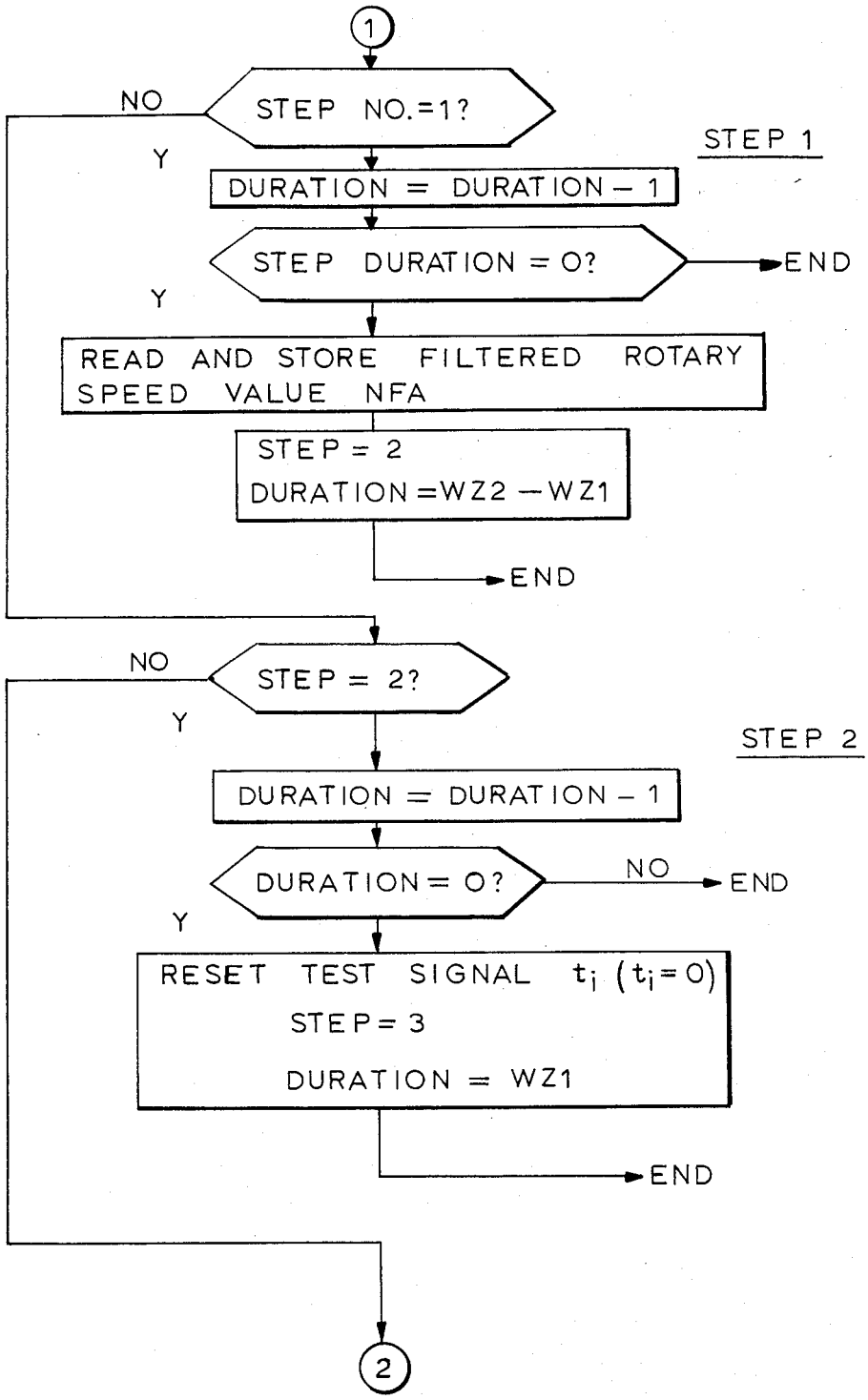
Figure 7C:
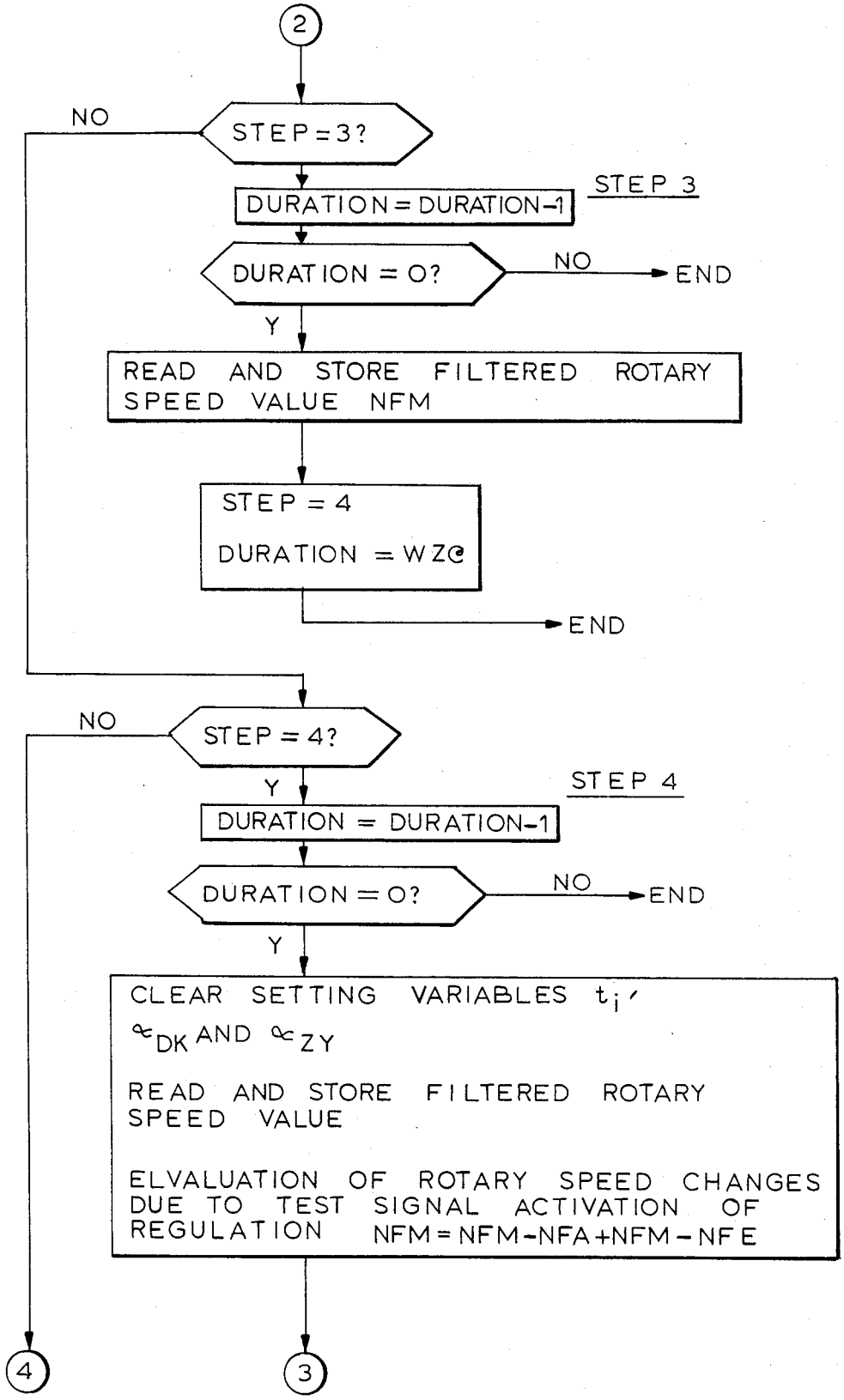
Figure 7D:
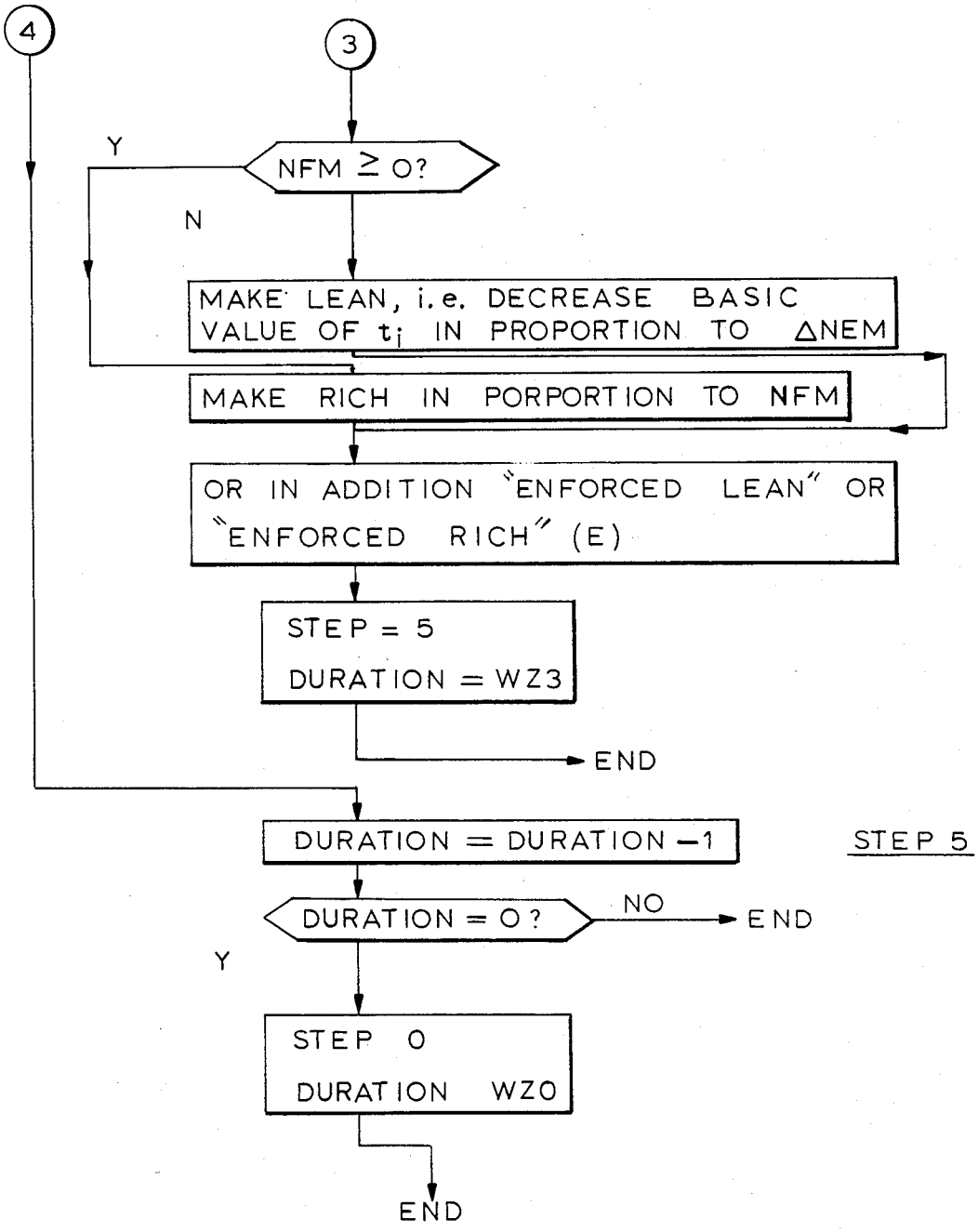

FIG. 6 shows in a block circuit diagram a device for carrying out the method of this invention. An internal combustion engine BM is connected in conventional manner to an intake arrangement including a throttle plate DK and an air filter LF. The intake arrangement also includes a fuel injection valve ED and a rotary speed sensor DG. Fuel injection valve ED is supplied with fuel from a storage tank KT. The position of the throttling plate DK is controlled by a setting motor MO. In addition, for controlling the engine BM by user, there is provided a gas pedal FP. The angular position of the gas pedal is sensed by a non-illustrated sensor and the corresponding control signal $\alpha_{FP}$ is applied to generators of characteristic lines KF1 and KFZ and to a regulator RE. The output voltage of the rotary speed sensor DG is applied via a filter FI to the regulator RE and to the generators KF1 and KFZ of the sets of characteristic lines.

The output of the generator of the first set of characteristic lines KF1 delivers a digital value determining the injection time interval $t_i$ and its digital value is applied to an input of a first summer SU1. The second input of the first summer SU1 is connected to the output of the regulator R1 delivering a digital value which determines the increase $\Delta t_i$ of the injection time interval $t_i$. The output signal from the first summer SU1 is amplified in an amplifier VE1 and applied to the fuel injection valve ED. The output of the second generator of the second set of characteristic lines KFZ is connected to an input of a second summer SU2 to apply to the latter a digital value corresponding to the angular position $\alpha_{DK}$ of the throttling plate DK. The other input of the secon summer SU2 is connected to a second output of the regulator RE. This second output delivers a digital value $\alpha_{DK}$ which is employed for changing the position of the throttling plate. The output signal from the second summer SU2 is amplified in a second amplifier VE2 and applied to the setting servomotor MO. Before the second amplifier VE2 there is a non-illustrated D-A converter which converts the digital value from the second summer into a voltage and before the first amplifier there is also provided a non-illustrated digital-time converter which converts the digital signal from the first summer into the injection time interval $t_i$.

The method of this invention will now be described with reference to FIGS. 5 and 6. The regulator RE shown in the block circuit diagram of FIG. 6 generates test signals used for wobbling air supply or fuel injection time interval. The regulator RE recognizes the change of the machine torque M from the change of the rotary speed n. In dependency on the change of the torque M the sets of characteristic lines generated by generators AF1 and KFZ can be affected by means of the regulator. The generator of the first set of characteristic lines KF1 produces at its output a function $$t_i = f(\alpha_{FP}, n);$$

the generator of the second set of characteristic lines KFZ delivers at its output the function $$\alpha_{DK} = f(\alpha_{FP}, n).$$

In this manner different regulating methods can be realized, for example, a regulation of rotary speeds during idling, regulation for minimum fuel consumption at partial load operational range, and at maximum throughput of air-regulation for maximum power output during full load. As mentioned before, it is also possible to realize a fully automatic speed regulation.

In this exemplary embodiment of the method of this invention, there is employed the known principle of the so-called extreme value regulation. The regulation occurs in individual consecutive test cycles. In FIG. 5, there is illustrated such a test cycle for regulating a maximum power output on the engine.

A regulation for a minimum specific fuel consumption has in principle the same course as that in the regulation for maximum output as illustrated in FIG. 5. The only difference is in the fact that in the second case the test signal time TS is not employed for regulating the injection time interval $t_i$ as illustrated in FIG. 5A but is employed for regulating the opening $\alpha_{DA}$ of the throttling plate. Also in the final evaluation process E instead of enrichment of the fuel mixture, the latter must be made leaner.

In the following description, the method of this invention will be described in connection with a regulation for a maximum power output of the engine.

The step duration SD (FIG. 5E) is always an integer multiple of a basic scanning or reading interval AI which in turn is an integer multiple either of the cycle of the engine or of a fixed time interval for example of 10 milliseconds. The step duration WZO is reversed for the testing time B. The step duration WZ1 represents a retardation time or dead time. The step duration WZ2 equals to the duration of test signal TS. The duration of step WZ3 includes a building up time after the action of the regulator and a waiting time up to the next test cycle TZ.

During the time period A (FIG. 5C) the filtered rotary speed voltage values NFA, NFM and NFE are detected. Alternatively, the time of rotation can be used as a reciprocal value of the rotary speed n to determine the latter. The evaluation E in this case must be designed accordingly. The rotary speed signal n must be filtered in order to suppress stochastic or random interferences. In the preferred embodiment, the filter FI (FIG. 6) is for example a digital low pass filter of second order with a damping of 0.7 to 1.0. The sharp cutoff frequency of the filter should be inversely proportional to rotary speed n and the sensing or basic scanning interval AI is also proportional to the time of rotation of the machine. In addition, the sharp cutoff frequency of the filter FI during idling should be about 1 Hertz.

The regulation according to the method of this invention is applicable only in the case when the filtered rotary speed is approximately constant or it changes with a constant, not too large acceleration or deceleration. During the duration WZO of the step SNO, three consecutive rotary speed values are measured during the test time B and the corresponding differences are computed and evaluated. In the course of one base scanning interval AI, a first rotary speed value NF1, a second rotary speed value NF2 and a third rotary speed value NF3 are measured. Then, the differences $\Delta NF1 = NF2 - NF1$, and $\Delta NF2 = NF3 - NF2$ are computed. Both differences must not exceed a corresponding limit value whereby the two limit values are permitted to differ one from the other by small amount. The two limit values can depend on rotary speeds and/or on the load. If one of the two values is exceeded then the test cycle TZ is not initiated.

Furthermore, such a regulation is possible or permissible only if there is no intervention from the side of the driver of the motor vehicle followed by changing position $\alpha_{FP}$ of the gas pedal. Therefore, during the entire time period C (FIG. 5E) check is made whether during the test cycle TZ such an intervention has been made. For this purpose, the difference between the starting position $\alpha_{FP1}$ of the gas pedal at the beginning of the test cycle TZ and the momentary gas pedal position $\alpha_{FP}$ is measured in each test cycle TZ during the entire time interval C. The difference between the momentary gas pedal position $\alpha_{FP}$ and the starting position $\alpha_{FP1}$ must not exceed a predetermined limit value. If this condition is violated, then the test cycle TZ is immediately interrupted.

In order to obtain a non-ambiguous correlation between the change of time interval $\Delta t_i$ (in a regulation for a minimum consumption of the change $\alpha_{DK}$) and the change of rotary speed $\Delta_n$ all other setting variables which might affect the rotary speed n must be kept constant. The other variables are particularly the basic value of the fuel injection time $t_i$ to which the increment $\Delta t_i$ is to be superposed, the angular position $\alpha_{DK}$ of throttling plate to which, if desired, an incremental signal $\Delta\alpha_{DK}$ can be superposed, and the ignition angle $\alpha_Z$. All these setting variables are during the time period T held constant.

At the time point E the evaluation of the test cycle TZ takes place and if necessary the regulator is activated. Thereafter the change of rotary speed is determined according to the formula $$\Delta NFM = NFM - NFA + NFM - NFE.$$

If the result of the evaluation ΔNFM is less than zero, than in the case of regulation for maximum power output a leaner fuel mixture is adjusted by reducing the base value of the fuel injection time interval $t_i$. Preferably this lowering of $t_i$ is made proportionally to the change of rotary speed ΔNFM. If the rotary speed change ΔNFM is greater than or equal to zero, then an enrichment of the mixture follows, that is the base value of injection time interval $t_i$ is increased. Even this fuel enrichment is preferably made in proportion to the change of the rotary speed ΔNFM.

In many cases it may be also of advantage not to regulate directly for a maximum output but for achieving a mixture which is slightly shifted to lean values. This regulation can be obtained in such a way that during each actuation of the regulator, independently from its direction and intensity, the mixture is additionally rendered leaner by a certain constant measure. This modification can be designated as an enforced fuel depletion. In the case of a regulation for a minimum fuel consumption a corresponding fuel enrichment can be provided. In the following the method of this invention will be disclosed by way of an example of a regulation for maximum power input in a flow diagram for a computerized controlling and/or regulating system.

Starting conditions of the program are present at the method step zero, at the beginning of the step duration WZO. At this time point the signal increment $\Delta t_i = 0$. A test cycle TZ is fed in the course of the base scanning or reading interval AI.

The flow diagram of this computerized example of the method of this invention is shown in FIGS. 7*a* through 7*d*.

It will be understood that each of the elements described above, or two or more together, may also find a useful application in other types of constructions differing from the types described above.

While the invention has been illustrated and described as embodied in specific examples of fuel supply regulating and/or controlling device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of controlling fuel supplied to an internal combustion engine by means of fuel injection, wherein an injection time interval ($t_i$) and hence an injected quantity ($M_B$) of fuel is determined in dependency on at least two engine parameters, such as gas pedal position ($\alpha_{FT}$) and rotary speed (n) of the engine, and thereafter a quantity ($M_L$) of air is induced through throttling means (DK) in dependency on the injection time interval ($t_i$); comprising the steps of:

establishing a test cycle (TZ) on the basis of predetermined test time intervals (ZT);

increasing, during a predetermined test signal time (TS) at the beginning of a test cycle (TZ), the injection time interval $t_i$ by a predetermined increment ($\Delta t_i$);

measuring, in the course of the test cycle (TZ), the rotary speed (n) substantially at the beginning (NFA), at the center (NFM) and at the end (NFE) of the test cycle (TZ);

substantially after expiration of the test signal time (TS) after the end of the test cycle (TZ), adjusting the injection time interval ($t_i$) in dependency on the measured change of rotary speed n at the center (NFM) of the test cycle; the test cycle (TZ) being initiated and/or maintained only under the condition that the gas pedal position ($\alpha_{FT}$) is substantially retained; and further comprising the steps of measuring during a preliminary step (WZO) at the beginning of the test cycle (TZ) the initial position ($\alpha_{FP1}$) of the gas pedal, then measuring during a period (C) of the test cycle (TZ) the momentary position ($\alpha_{FP}$) *of the gas pedal, continuously computing a difference* ($\Delta\alpha = \alpha_{FP}1 - \alpha_{FP}$) between the initial gas pedal position and the momentary gas pedal positions, and interrupting the test cycle (TZ) when the computed difference ($\Delta\alpha$) between the gas pedal positions exceeds a predetermined maximum value.

2. A method of controlling fuel supplied to an internal combustion engine by means of fuel injection, wherein an injection time interval ($t_i$) and hence an injected quantity ($M_B$) of fuel is determined in dependency on at least two engine parameters, such as gas pedal position ($\alpha_{FT}$) and rotary speed (n) of the engine and thereafter a quantity ($M_L$) of air is induced through throttling means (DK) in dependency on the injection time interval ($t_i$), comprising the steps of:

establishing a test cyle (TZ) on the basis of predetermined test time intervals (ZT);

increasing, during a predetermined test signal time (TS) at the beginning of a test cycle (TZ), the injection time interval $t_i$ by a predetermined increment ($\Delta t_i$);

measuring, in the course of the test cycle (TZ), the rotary speed (n) substantially at the beginning (NFA), at the center (NFM) and at the end (NFE) of the test cycle (TZ);

substantially after expiration of the test signal time (TS) after the end of the test cycle (TZ), adjusting the injection time interval ($t_i$) in dependency on the measured change of rotary speed n at the center (NFM) of the test cycle; measuring the rotary speed (n) by a sensor whose output rotary speed signal is filtered in order to eliminate random interferences, the rotary speed signal being filtered in a digital low pass filter (FI) of second order having an average damping below 1.0 and a cutoff frequency which is inversely proportional to the rotary speed (n).

3. A method of controlling fuel supplied to an internal combustion engine by means of fuel injection, wherein an injection time interval ($t_i$) and hence an injected quantity ($M_B$) of fuel is determined in dependency on at least two engine parameters, such as a gas pedal position ($\alpha_{FT}$) and rotary speed (n) of the engine, and thereafter a quantity ($M_L$) of air is induced through throttling means (DK) in dependency on the injection time interval ($t_i$), comprising the steps of:

establishing a test cycle (TZ) on the basis of predetermined test time intervals (ZT):

increasing, during a predetermined test signal time (TS) at the beginning of a test cycle (TZ), the injection time interval $t_i$ by a predetermined increrent ($\Delta t_i$);

measuring, in the course of the test cycle (TZ), the rotary speed (n) substantially at the beginning (NFA), at the center (NFM) and at the end (NFE) of the test cycle (TZ);

substantially after expiration of the test signal time (TS) after the end of the test cycle (TZ), adjusting the injection time interval ($t_i$) in dependency on the measured change of rotary speed n at the center (NFM) of the test cycle;

establishing in a preliminary step (WZO) at the beginning of the test signal time (TS) of the test cycle a test time period (B) for testing momentary operational variables of the engine; and further comprising the following steps:

testing during the test time period (B) the approximate constancy of the rotary speed of the engine by making three consecutive rotary speed measurements (NF1, NF2, NF3), then computing from the results of said measurements differences (ΔNF1, ΔNF2) between two consecutive measurements (NF2−NF1 and NF3−NF2) performed respectively in reading interval (AI): and triggering the test signal (TS) under the condition that the rotary speed differences (ΔNF1, ΔNF2) do not exceed a predetermined limit value.

4. A method as defined in claim 3, wherein said limit value or the rotary speed differences depends on the rotary speed of the engine.

5. A method as defined in claim 3, wherein the limit value for the rotary speed differences depends on engine load and on the injection time interval ($t_i$).

6. A method of controlling composition of fuel-air mixture to be supplied to an internal combustion engine wherein a quantity of fuel is determined in dependency on at least two parameters of the engine, particularly on a gas pedal position ($\alpha_{FP}$) and on rotary speed (n) of the engine, and a quantity of air is subsequently induced by means of a setting member such as a throttling plate in dependency on the quantity of fuel; comprising the steps of:

preliminarily controlling the quantity of fuel and the quantity of air via means for generating sets of characteristic curves to produce preliminary control values ($Q_L$, $Q_K$), superposing a test signal to at least one of said preliminary control values to produce wobbling of engine torque, detecting a torque change caused by the test signal, and changing the corresponding set of characteristic curves according to the detected torque change so as to optimize the torque.

7. A method as defined in claim 6, wherein the set of characteristic curves pertaining to the quantity of fuel is controlled in proportion to rotary speed (n) and to the gas pedal position ($\alpha_{FP}$), and the set of characteristic curves pertaining to the quantity of air is controlled in proportion at least to a metered quantity of fuel.

8. A method as defined in claim 7, wherein the set of characteristic curves for the quantity of air is additionally controlled in proportion to rotary speed of the engine.

9. A method of controlling fuel supplied to an internal combustion engine by means of fuel injection, wherein an injection time interval ($t_i$) and hence an injected quantity ($M_B$) of fuel is first determined in dependency on at least two engine parameters, such as a gas pedal position ($\alpha_{FT}$) and rotary speed (n) of the engine, and thereafter a quantity ($M_L$) of air is induced through throttling means (DK) in dependency on the injection time interval ($t_i$), comprising the steps of:

establishing a test cycle (TZ) on the basis of predetermined test time intervals (ZT);

increasing, during a predetermined test signal time (TS) at the beginning of a test cycle (TZ), the injection time interval $t_i$ by a predetermined incremcnt ($\Delta t_i$);

measuring, in the course of the test cycle (TZ), the rotary speed (n) substantially at the beginning (NFA), at the center (NFM) and at the end (NFE) of the test cycle (TZ); and substantially after expiration of the test signal time (TS) after the end of the test cycle (TZ), adjusting the injection time interval ($t_i$) in dependency on the measured change of rotary speed n at the center (NFM) of the test cycle.

10. A method as defined in claim 9, wherein the change of the injection time interval ($t_i$) controls the power output of the engine.

11. A method as defined in claim 9, wherein the test time interval (ZI) is selected to be a multiple of a rotation time of the engine.

12. A method as defined in claim 9, wherein the test time interval (ZI) is selected to be a fraction of the rotary speed of the engine.

13. A method as defined in claim 9, wherein the test time interval (ZI) is a predetermined fixed time interval.

14. A method as defined in claim 9, wherein the rotary speed (n) is measured by a sensor whose output rotary speed signal is filtered in order to eliminate random interferences.

15. A method as defined in claim 9, wherein a delay time period (WS1) is reserved at the beginning of the test signal time (TS) before the measurement of the initial rotary speed (NFA).

16. A method as defined in claim 9, wherein a delay time (WS1) is reserved after the termination of the test signal time (TS) and before the measurement of the intermediate rotary speed (NFM).

17. A method as defined in claim 9, wherein the measurement of the rotary speed n at the end of the test cycle is performed within a time interval (WZ2) following the rotary speed measurement at the center (NFM) of the test cycle, said time interval (WZ2) being equal in length to the test signal time (TS).

18. A method as defined in claim 9, wherein after the completion of the test cycle (TZ) a waiting time period (WZ3) is reserved up to the beginning of the next test cycle.

19. A method as defined in claim 9, wherein the test cycle (TZ) is initiated and/or maintained only under the condition that the gas pedal position ($\alpha_{FT}$) is substantially retained.

20. A method as defined in claim 9, wherein during the test cycle (TZ), in an evaluation period (D), the basic value of the injection time interval ($t_i$) resolves the time increment ($\Delta t_i$), is held constant.

21. A method as defined in claim 9, wherein during the test cycle (TZ), in an evaluation time period (D), an ignition angle ($\alpha_Z$) is held constant.

22. A method as defined in claim 9, wherein the injection time interval ($t_i$) is changed after the completion of the rotary speed measurement (NFE) at the end of the test cycle (TZ).

23. A method as defined in claim 22, wherein the measuring and controlling steps are performed in a scanning interval (AI) which is a natural fraction of the test time interval (ZI).

24. A method as defined in claim 9, wherein a test time period (B) for testing momentary operational variables of the engine is established in a preliminary step (WZO) at the beginning of the test signal time (TS) of the test cycle.

25. A method as defined in claim 24, comprising the steps of:

measuring during a test time (B) of the preliminary step (WZO) an engine load which is proportional to the injection time interval ($t_i$), testing a condition for controllability ($t_i$ is much greater than zero), and in the case when a condition of non-controllability is detected ($t_i$ equals approximately zero), interrupting the test cycle (TZ).

26. A method as defined in claim 9, comprising the steps of:

determining whether a significant rotary speed change ($\Delta NFM = NFM - NFA + NFM - NFE$ is not equal to zero) has occurred, determining the sign (greater or less than zero) of the rotary speed change ($\Delta$NFM), and according to the sign of the rotary speed change, making the fuel mixture leaner or richer.

27. A method as defined in claim 26, wherein the step of making the fuel mixture leaner or richer is accomplished by adjusting the base value of the injection time interval ($t_i$) or a base position ($\alpha_{DK}$) of throttling means in proportion to a rotary speed change ($\Delta$NFM).

28. A method as defined in claim 27, wherein during each adjustment of the fuel mixture the latter is enriched or made leaner by a predetermined amount ($\pm\Delta t_i$ or $\alpha_{DK}$) independently on the direction and magnitude of the adjustment.

* * * * *